US006108591A

United States Patent [19]

Segal et al.

[11] Patent Number: 6,108,591

[45] **Date of Patent: *Aug. 22, 2000**

[54] METHOD AND APPARATUS FOR VALIDATING VEHICLE OPERATORS

[75] Inventors: Michael L. Segal, Encinitas; David T. Chesavage; Thomas F. Doyle, both of San Diego, all of Calif.

[73] Assignee: QUALCOMM Incorporated, San Diego, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 09/010,949

[22] Filed: Jan. 22, 1998

[51] Int. Cl.[7] ..... G07C 5/00

[52] U.S. Cl. ..... 701/1; 701/32; 701/117; 713/202

[58] Field of Search ..... 701/32, 117, 300, 701/1, 50; 340/989, 990, 426; 455/410, 411, 427, 456, 457; 713/201, 202

[56] References Cited

U.S. PATENT DOCUMENTS

| | | | |
|---|---|---|---|
| 5,155,689 | 10/1992 | Wortham | 455/456 |
| 5,212,832 | 5/1993 | Ness-Cohn | 455/514 |
| 5,327,347 | 7/1994 | Hagenbuch | 701/50 |
| 5,655,077 | 8/1997 | Jones et al. | 713/201 |
| 5,660,246 | 8/1997 | Kaman | 180/287 |
| 5,844,473 | 12/1998 | Kaman | 340/439 |

FOREIGN PATENT DOCUMENTS

| | | |
|---|---|---|
| 0451482 | 10/1991 | European Pat. Off. . |
| 0592166 | 4/1994 | European Pat. Off. . |
| 0708427 | 4/1996 | European Pat. Off. . |
| 0731008 | 9/1996 | European Pat. Off. . |
| 0745959 | 12/1996 | European Pat. Off. . |
| 9401978 | 1/1994 | WIPO . |

OTHER PUBLICATIONS

"Personal Digital Radio Service" IBM Technical Disclosure Bulletin, vol. 38, No. 8, Aug. 1995, pp. 315–316, XP002103783.

Patent Abstracts of Japan, vol. 015, No. 033 (P–1158), Jan. 25, 1991 JP 02 271500 A (N T T Chuo Idou Tsushin KK), Nov. 6, 1990.

Beurel, B., "Satellite Messaging Systems." Commutation & Transmission, vol. 15, NR.7, pp. 103–108. XP000396195; 1993.

*Primary Examiner*—Michael J. Zanelli
*Attorney, Agent, or Firm*—Philip R. Wadsworth; Thomas M. Thibault

[57] ABSTRACT

A method and apparatus for identifying and validating vehicle operators to multiple electronic systems, such as fleet management centers and electronic monitoring systems, in a communication system. The invention is particularly useful in the commercial trucking industry where multiple electronic applications require the identification of a vehicle operator. Each vehicle operator in the communication system is preassigned a unique identification code which is used to request a login or logoff from the validation system. A database of all vehicle operator identification codes is stored at a central station. The identification code is transmitted from the vehicle to the central station when a login or logoff is desired. If the identification code of the requesting operator is found in the database, any electronic system requiring the vehicle operator's identification is notified of the login of logoff event and the identification of the vehicle operator requesting the event.

28 Claims, 5 Drawing Sheets

METHOD AND APPARATUS FOR VALIDATING VEHICLE OPERATORS

BACKGROUND OF THE INVENTION

I. Field of the Invention

The present invention relates generally to vehicle monitoring systems and more particularly to the identification and validation of a vehicle operator to more than one electronic system.

II. Description of the Related Art

It is now commonplace in the commercial trucking industry, as well as other industries in which goods are shipped, to equip vehicles with a variety of electronic monitoring systems. These electronic monitoring systems can provide useful information regarding the performance of the vehicle to fleet operators. Such performance characteristics can include engine speed, engine RPM, idle time, and so forth. Electronic monitoring systems can also provide other useful information such as vehicle location, route analysis, and miles traveled per jurisdiction for fuel tax calculation purposes. Other electronic applications found in the commercial trucking industry include voice/text messaging, security systems, and electronic mail or e-mail.

In many instances, these electronic systems each require the identity of the vehicle operator. For example, an electronic monitoring system which records various vehicle operating characteristics may require the identity of the operator so that the operating characteristics can be attributed to an identified operator. By knowing which vehicle operator is responsible for each set of data, fleet managers can reward those operators who meet certain performance goals. An example of such a system is the SensorTRACS® electronic monitoring system, sold by Qualcomm, Incorporated.

Another electronic system which requires the identity of a vehicle operator is an e-mail system. It is necessary to identify vehicle operators so that e-mail messages may be routed to the appropriate vehicle. An onboard security system may also require the identity of the vehicle operator to determine if that operator is authorized to operate the vehicle.

Yet another electronic system which requires the identify of a vehicle operator is one implementing automatic generation of Department of Transportation (DOT) driver logs. In the past, these driver logs were generated manually by vehicle operators. Present systems contemplate an automatic system which monitors various aspects of a vehicle pertinent to the generation of a driver log. For example, electronic monitoring systems are able to track a vehicle's travel route and stop time, which are key elements in generating the DOT driver log. This system requires the identity of the vehicle operator so that the information recorded by the automatic monitoring system can be attributed to a particular driver and a legal document (the DOT log) created from the information.

In order to identify vehicle operators, a unique identification code and password is assigned to each operator. The identification code and password must be manually entered into each electronic system used onboard the vehicle prior to operation.

Typically, the electronic monitoring systems do not communicate with each other, thus requiring a separate login and logoff for each system.

As more of these electronic systems are installed into commercial vehicles, vehicle operators will be forced to validate individually with each system prior to use. It will also force vehicle operators to log off of each electronic system once they are finished operating the vehicle. This could create many problems for fleet management. For example, after logging on to several electronic systems on a first vehicle, a vehicle operator may forget to log off one or more electronic systems and begin operating a second vehicle. A second vehicle operator might then begin operating the first vehicle without logging on to one or more electronic systems. It might then become difficult to determine which operator was responsible for which set of data.

SUMMARY OF THE INVENTION

The present invention is a method and apparatus for identifying and validating vehicle operators to one or more electronic systems. The invention requires a single vehicle operator validation, no matter how many individual electronic systems are used. Similarly, a single log off is all that is required to notify each electronic system of an operator logoff. The present invention eliminates the confusion that can result from requiring an individual login and logoff for each electronic system in use.

The present invention is designed to operate in conjunction with an existing fleet management communication system. Such communication systems typically comprise a central station in communication with individual vehicles via satellite, the vehicles dispersed throughout a large geographic area. One or more fleet management centers can communicate with their respective vehicles and vice-versa through the central station. Communications may consist of data representative of various operating characteristics of the vehicle, such as vehicle speed, engine RPM, and idle time. Position determination of the vehicle and text messaging are additional features typically used with such communication systems.

The present invention utilizes a database, typically located at a central station, which stores information to validate vehicle operators. In addition, the database stores other information associated with each vehicle operator. The database is accessible to fleet management and may be modified at any time. A unique vehicle operator identification code is pre-assigned to each vehicle operator in the fleet. A vehicle operator may log onto the validation system as an active or an inactive operator. An active operator denotes one that is operating a vehicle.

To request a login to the validation system, a vehicle operator must enter his unique identification code via a user input device onboard a vehicle. Once the vehicle operator has been verified by the database at the central station as being a valid operator, a corresponding vehicle operator status is changed to "logged in" at the database. An acknowledgment message is transmitted from the central station to the vehicle which requested the login indicating whether or not the login request was successful. If the login request was successful, the vehicle operator is allowed access to other electronic systems, both onboard and remote from the vehicle. In the case of onboard electronic systems, other information necessary to these systems is transmitted along with the acknowledgment message.

Upon a successful login, all information generated by the vehicle will be associated with the active operator. For example, the vehicle location, vehicle speed, engine RPM, and idle time may then be recorded and associated with the active operator until a log off from the system is requested. Any e-mail directed to a "logged in" operator, either active or inactive, is routed to the appropriate vehicle without requiring an additional validation to the e-mail system. An automatic DOT driver log may be created without having to log onto the system which creates the automatic logs, and so on.

When a vehicle operator wishes to log off from the validation system, a single log off is all that is required to notify each electronic system of the request. If a vehicle operator fails to log off from a first vehicle and then logs onto a second vehicle, the validation system can detect that the operator is already logged onto the system, and will automatically log that operator off of the first vehicle. Similarly, if a first driver fails to log off of a vehicle and a second operator logs on to the same vehicle, the validation system will automatically change the first operator's status to "inactive" onboard that vehicle, so that the second operator will be associated with all further vehicle performance information.

BRIEF DESCRIPTION OF THE DRAWINGS

The features, objects, and advantages of the present invention will become more apparent from the detailed description set forth below when taken in conjunction with the drawings in which like reference characters identify correspondingly throughout and wherein.

DETAILED DESCRIPTION OF THE PREFERRED EMBODIMENTS

The method and apparatus of operator validation and verification of the present invention is best illustrated in the context of a land based mobile unit, typically for use in a vehicle in the commercial trucking industry. It should be understood, however, that the present invention may be used in any application where vehicle operator validation and verification is desired, especially in applications where multiple electronic systems requiring operator identification are used. The components required for operator validation and verification are depicted in FIG. 1.

Figure 1:
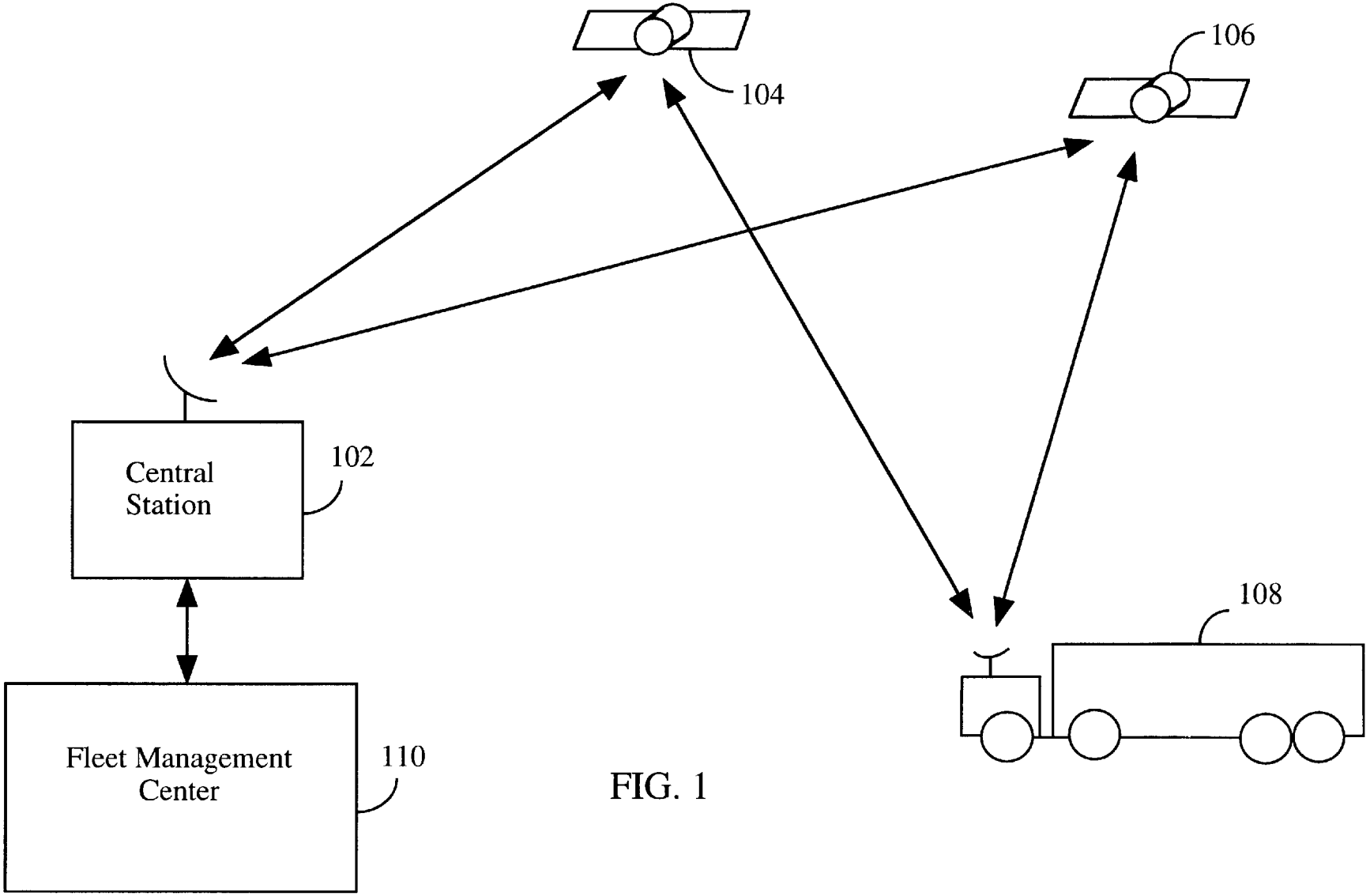
FIG. 1 illustrates a satellite-based communication system.

In FIG. 1, fleet management center 110 and vehicle 108 are capable of communication with each other via central station 102 and data satellite 104. The present invention is not limited to a satellite communication system, however. Any wireless terrestrial communication system may be used as well, including, but not limited to, Land Mobile Radio (LMR), short wave, cellular, or PCS systems. In addition, although only a single fleet management center 110 is depicted in FIG. 1, in actuality a plurality of independent fleet management centers are employed throughout the system and may communicate with their respective fleet vehicles via central station 102 and data satellite 104.

In the exemplary embodiment, vehicle 108 is a commercial trucking vehicle having a mobile communications terminal (MCT) mounted in the tractor or cab of the vehicle, not shown. The mobile communications terminal is capable of respectively transmitting and receiving communication signals to and from central station 102 via data satellite 104. Again, it should be understood that the MCT is any device capable of communicating with central station 102 using the pre-established communication method of choice. Furthermore, the location of vehicle 108 can be determined by using data satellite 104 and positioning satellite 106. It is well known in the art that vehicle locations may be determined via satellite, for example through trilateration from a dual satellite navigation system as disclosed in U.S. Pat. No. 5,017,926, entitled "DUAL SATELLITE NAVIGATION SYSTEM AND METHOD, assigned to the assignee of the present invention and incorporated by reference herein.

Vehicle 108 may transmit useful information to fleet management center 110 regarding the performance characteristics of the vehicle while it is operating. For example, vehicle speed, RPM, and idle time may be transmitted to fleet management center 110 for processing and storage. Such information is useful to fleet management to track operation costs and identify wasteful practices such as excessive idle time or speeding. In addition, by knowing which operator is responsible for which set of data, vehicle operators who maintain acceptable driving habits may be rewarded, while those who consistently fail to meet management imposed standards can be dealt with appropriately. Vehicles equipped with such a vehicle monitoring system typically require the vehicle operator to log into the system, usually by entering an identification code into a user interface device onboard the vehicle. The identification code is then used in conjunction with any performance data generated while the vehicle is operated.

Other electronic systems may require vehicle operator identification as well. For example, e-mail is now available to truck drivers while on the road. Typically, e-mail systems require operator identification so that messages may be transmitted to the vehicle in which the intended operator is located. Normally, an independent login to the e-mail system, in addition to the login required for the electronic monitoring system, would be necessary by the vehicle operator.

The Department of Transportation (DOT) is currently in the process of evaluating whether to allow automatic driver logs in lieu of manual logs. In the past, various driving parameters such as daily drive time, rest time, and route information was provided manually by vehicle operators. With the widespread availability of electronic monitoring systems, especially vehicle location systems, the Department of Transportation now allows this data to be provided automatically using electronic monitoring systems. Consequently, each vehicle operator must be matched with the appropriate vehicle data so that an accurate and personal log may be generated. Again, a separate login to the DOT log system is generally necessary.

A variety of security features may be incorporated into the communication system of FIG. 1. For example, a security system which does not allow the vehicle to be started unless a valid operator identification code is entered could be used. The identification code can be communicated to central station 102 or fleet management center 110 where it can be validated. The advantage to communicating the operator identification information to central station 102 is that a dynamic database of allowable operators can be maintained and altered by fleet management at any time.

Other security features are possible using the validation system of the present invention. For example, if a vehicle operator attempts to log onto the system unsuccessfully, a security alert can be transmitted to central station 102 if a predetermined number of attempts is exceeded. Another security alert is possible if the vehicle is operated for more than a predetermined distance or time without having a valid operator logged on. Of course, this situation assumes that the lock-out feature described above is not implemented. An additional feature of the security system is that a subtle audible tone will prompt the operator to log onto the system if the vehicle is operated without a valid operator. A further security feature is that a vehicle operator may be logged off of the validation system automatically after a predetermined amount of time passes after the vehicle has been turned off.

Figure 2:
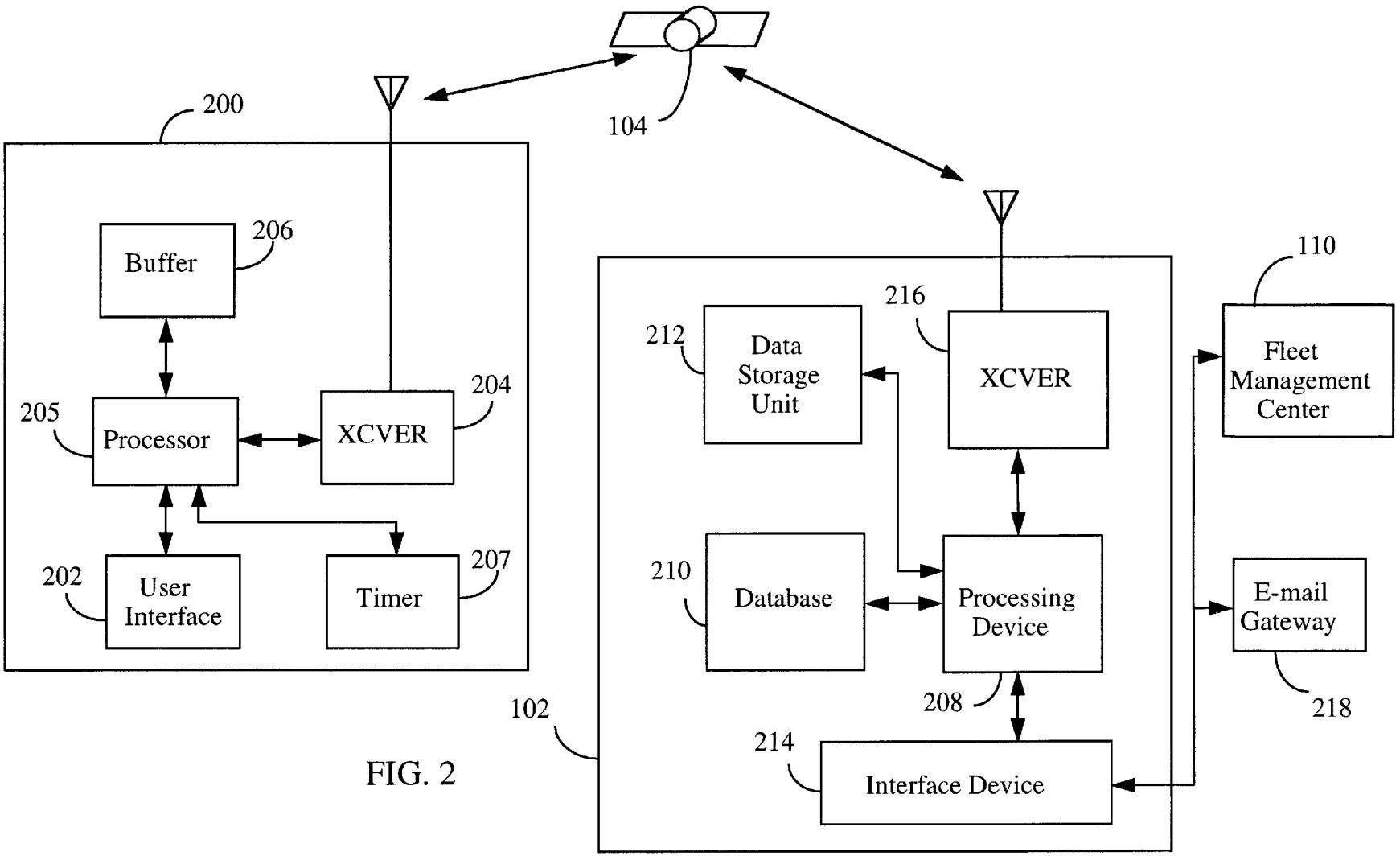
FIG. 2 illustrates a more detailed view of the satellite-based communication system and validation system of the present invention.

FIG. 2 illustrates a detailed view of the validation system. Shown is MCT 200, user interface 202, transceiver 204, buffer 206, timer 207, processor 205, data satellite 104, central station 102, transceiver 216, processing device 208, database 210, data storage unit 212, interface device 214, e-mail gateway 218, and fleet management center 110. It should be understood that each vehicle in the communication system has its own MCT 200. MCT 200 is located onboard vehicle 108 while central station 102, fleet management center 110 and e-mail gateway 218 are each located remotely from each other, although in an alternative embodiment, these components could be positioned at a single location.

Each vehicle 108 in the communication system is assigned a unique vehicle identification code so that it may be differentiated from other vehicles in the fleet. The vehicle identification code may be any alphanumeric sequence which uniquely identifies the vehicle, however, in the exemplary embodiment, the vehicle identification code is the serial number associated with MCT 200. The vehicle identification code may be stored in buffer 206, or in another memory device, not shown, within MCT 200. Buffer 206 may be used to store information generated by vehicle 108, such as information pertaining to the performance of the vehicle generated by an electronic monitoring system.

To request access to the validation system, i.e., to request a login or a logoff, a vehicle operator must enter a preassigned vehicle operator identification code via user interface 202. The vehicle operator identification code is typically in the form of a username and password, although other formats are possible. User interface 202 typically is a keyboard and video display unit to which a series of alphanumeric key sequences may be entered and displayed to the vehicle operator. However, other user interfaces may be used in lieu of the keyboard and video display unit such as a magnetic card reader which processes a vehicle operator identification code by reading a preprogrammed magnetic strip on a small, rigid card. The access request, vehicle operator identification code, and an indication of when access was requested is stored in buffer 206. The vehicle identification code may be stored in buffer 206 as well, as explained above.

The indication of when access is requested may be in the form of a date and time, or other methods may be used to establish when access is requested. In the exemplary embodiment, the number of seconds elapsed after 00:00:00, Jan. 1, 1988 is used to identify the date and time that access is requested.

Vehicle operators may log onto the validation system as either an active or an inactive operator. An active operator is defined as one operating the vehicle, while an inactive operator is one who is not presently operating the vehicle, but is in proximity to the vehicle. Examples of an inactive operator are co-drivers or an active operator on a break. When a login occurs, the vehicle operator's status, either active or inactive, is stored in buffer 206, or in another memory device within MCT 200 (not shown).

It is important to note that in the exemplary embodiment of the present invention, the active/inactive operator status is not transmitted to central station 102. A vehicle operator's status is stored at central station 102 as either "logged in" or "logged off." The details of this are explained later herein.

In one embodiment of the present invention, multiple vehicle operators may be logged onto the same MCT, however only one operator may be classified as the active operator at any given time. Each fleet management center may determine the maximum number of vehicle operators allowed on an MCT at any given time. In the exemplary embodiment, a maximum of five vehicle operators may be logged onto a single MCT, although only one may be logged on as an active operator. The whereabouts of both active and inactive operators are important to such electronic systems as e-mail. By logging on to the validation system, even as an inactive operator, the e-mail system will know which vehicle to route electronic messages.

Vehicle operators may change their status onboard vehicle 108 from active to inactive and vice-versa via user interface 202. Again, this information is not communicated to central station 102.

In the exemplary embodiment, upon a login request, vehicle operator identification code, vehicle identification code, and the time and date of the login request is transmitted by MCT 200 via transceiver 204, data satellite 104, and central station 102 where they are received by transceiver 216 and provided to processing device 208. Upon a logoff request, the vehicle operator identification code, vehicle identification code, and the date and time of the logoff request is transmitted. It should be understood that any one or a combination of these data items needs to be transmitted to central station 102, depending upon the application requiring validation. For example, it may be adequate to only transmit the vehicle operator identification code in order to validate that the operator is authorized to operate a vehicle. In this situation, it may be unnecessary to know which vehicle is being operated or at what time and date an access request was generated.

Processing device 208 is a general computing device, typically a digital computer, which is connected to transceiver 216 for communicating with vehicle operators via MCT 200. In addition, processing device 208 is connected to database 210, data storage unit 212, and interface device 214. Processing device 208 is responsible for, among other things, granting access requests to vehicle operators after receipt of an access request, ie, a logon or logoff request. Processing device verifies that a received operator identification code is found in database 210, then notifies other electronic systems, such as fleet management center 110 or e-mail gateway 218, that a successful access has occurred.

The operator identification code received by processing device 208 is used to search database 210 for a matching operator identification code. Database 210 contains at least the vehicle operator identification code for every vehicle operator expected to make use of, or to be listed by, fleet management. Other information may be stored in database 210 corresponding to each vehicle operator identification code as well. For example, a second operator identification code, operator's full name, and/or social security number may be stored. Also, each vehicle operator's login status, i.e., logged in or logged off, is stored. This information is necessary for automatic DOT logs and extremely helpful to fleet management centers to identify, by name, operators who are using their vehicles. The second operator identification code may be necessary to interface to other electronic applications requiring an identification in another format other than what is used in the verification system of the present invention.

When a vehicle operator logs onto the validation system, the second operator identification code associated with that operator can be sent to other electronic applications requiring the alternate format. Thus, the vehicle operator need not remember, nor enter, multiple identification codes in order to become validated on a number of different electronic applications. Other information, such as an operator's last access request, vehicle identification code, and the date and time of the request, may also be stored. In the exemplary embodiment, database 210 stores a vehicle operator's full name, a SensorTRACS® identification number, an operator login status, an MCT identification number of the most recently logged in MCT, the time of a previous logoff, and the fleet management name to whom the operator is employed. SensorTRACS® is an electronic system sold by Qualcomm Incorporated used to communicate operating characteristics of a vehicle in transit.

In the exemplary embodiment, if the received operator identification code is found within database 210, the vehicle identification code and the time and date of the login request is stored in database 210 corresponding to the requesting operator. In addition, a login status corresponding to the requesting operator is changed to "logged in," meaning that operator is currently logged onto the vehicle. Processing device 208 then notifies one or more electronic systems of a successful access request by transmitting the operator identification code to each electronic system requiring validation. If an alternative format of identification is required by a particular electronic system, a second operator identification code, discussed above, may be transmitted instead.

In addition to transmitting the operator identification code to each electronic system, other information may be transmitted as needed. For example, a vehicle identification code corresponding to an access request may be transmitted to e-mail gateway 218, so that e-mail messages may be sent to the appropriate vehicle.

An acknowledgment message is transmitted to MCT 200 from processing device 208 and transceiver 216 indicating that an access request was received. If a login was requested, the acknowledgment message may send information to MCT 200 indicating whether the login request was successful or not. Other information may be transmitted along with the acknowledgment message as well, depending on whether the request was successful or not. If the login request was successful, information such as the vehicle operator identification code, the vehicle operator's full name, time of login, and a second identification code for use with onboard electronic systems may be transmitted. If the login request was unsuccessful, the vehicle operator identification code, time of failed login attempt, and an indication of why the failure occurred may be transmitted.

The transmitted information may be used by vehicle 108 for security purposes or for recording vehicle performance parameters via an electronic monitoring system. For example, if vehicle 108 is equipped with a security device to prevent an unauthorized vehicle start, a successful validation message enables vehicle 108 to begin operation. Otherwise, vehicle 108 will not be able to begin operation. Likewise, a second identification code can be provided to an electronic monitoring system for matching the vehicle's performance characteristics with the vehicle operator assigned to the second identification code.

An acknowledgment message, successful or not, may also be transmitted to the appropriate fleet management center 110 via interface device 214 upon each login or logoff attempt and also stored in either data storage unit 212 or in database 210 for later retrieval. Interface device 214 may be any device known in the art for communicating information from one location to another. Examples of interface device 214 include wireless transceivers, telephone interface devices, T1 interfaces, and so forth.

Occasionally, vehicle 108 will not be able to communicate with data satellite 104 because of a physical obstruction blocking the signal path. For example, vehicle 108 could be parked underneath an overpass or located inside a tunnel. MCT 200 attempts to contact data satellite 104 when a vehicle operator attempts to access the validation system. The date and time of the access attempt is recorded in buffer 206 along with the operator's identification code. If the acknowledgment message from central station 102 is not received within a predetermined amount of time, the information stored in buffer 206 is re-transmitted once more by transceiver 204. This cycle repeats until an acknowledgment message is received from central station 102.

Each vehicle operator's identification code must be unique to every vehicle operator in the communication system. The vehicle operator identification code can be any alpha-numeric combination, each having a minimum and maximum length to be determined by a system operator. The minimum length of identification code is dictated by the maximum number of vehicle operators expected in the system. The maximum length of either the username, password, or both may be constrained by the cost associated with communicating the information using data satellite 104. An example of an identification code could be a username and a password in combination. The username could be the vehicle operator's actual last name, first name, social security number, or a combination of these. The password can be any alpha-numeric sequence which, in combination with the username, uniquely identifies each vehicle operator in the system.

Other methods of uniquely identifying vehicle operators may be used. For example, each fleet management center in the communication system may assign a unique username to their respective employees, however, these usernames do not have to be unique throughout the entire system. Vehicle operators would still be uniquely identified system wide if the usernames were associated with the specific fleet management center from which any request was made. For example, if a first fleet management center and a second fleet management center both have Bob as a username in their centers, no confusion will result at the central station when the data record for Bob is accessed by either management center because each Bob in database 210 will be uniquely associated with his respective fleet management center.

Once a vehicle operator has successfully logged onto the validation system as an active operator at MCT 200, operating data from vehicle 108 may be stored corresponding to the active operator and associated vehicle. The operating data may be stored in buffer 206, in another memory onboard vehicle 108 (not shown), or transmitted to central station 102 and stored in database 210 or in another database, shown as data storage unit 212 in FIG. 2. The data may consist of vehicle positions, vehicle speed, RPM, and idle time, among others. Operating data will continue to be stored in the active operator's name until a logoff request is received from user interface 202 or a forced logoff is requested (explained below) from fleet management center 110. From this data, automatic DOT logs can be generated and fleet wide operating characteristics compiled for use in analyzing profitability.

When an operator wishes to log off from the validation system, a logoff request is entered via user interface 202. The logoff request requires the operator's unique, preassigned username and password. In the exemplary embodiment, a menu driven display is used to minimize input errors by the vehicle operator. An operator wishing to logoff from the validation system scrolls through a list of operators, selects his or her name, then enters the logoff request. The operator can choose to be logged off the system completely, or to have his operator status changed to "inactive." No password is needed to logoff from the validation system in the exemplary embodiment. At MCT 200, if the vehicle operator was logged in as an active operator, no further operational data will be attributed to him once a logoff is requested. Regardless of whether the operator was active or inactive, MCT 200 deletes the operator ID from buffer 206 so that another operator may log on as an inactive or active operator.

A vehicle operator may be automatically logged off of a first MCT by central station 102 if he or she attempts to log onto a second MCT. Upon receipt of a login request, processing device 208 first determines if the received username and password are valid in database 210. Next, processing device 208 checks the corresponding login status to see if the operator is already logged into the validation system, and if so, to which MCT. If the operator is logged onto another MCT, database 210 is modified to reflect that the operator is now logged onto the second MCT, and a message is transmitted to the first MCT ordering a logoff. At the first MCT, the vehicle operator is removed as an active or inactive operator and no further operational data is attributed to him.

Another situation where an automatic logoff can be initiated is when a predetermined amount of time has elapsed after a vehicle ignition switch is turned to the "off" position. Timer 207 is initiated by processor 205 after it detects that the vehicle ignition switch has been turned off. Timer 207 can be implemented in a variety of ways, including a stand-alone device or implemented by software. If timer 207 indicates that a predetermined amount of time has elapsed since the vehicle ignition switch has been turned off, the active operator logged into MCT 200 is logged off of the system via a message which is transmitted to central station 102. The logoff message contains the operator identification code, date and time stamp of the logoff, and the MCT identification code. In an alternate embodiment, after the predetermined amount of time has elapsed, the active operator is changed to inactive status in buffer 206. No message is transmitted to central station 102 in this case. After a second predetermined amount of time elapses, the operator is logged off of the validation system completely via a logoff request transmitted to central station 102.

If a previous vehicle operator having an active operator status has forgotten to log off from the validation system and a new operator wishes to log on as the active operator, the previous vehicle operator's status is changed from active to inactive in buffer 206. No message is transmitted to central station 102 informing it of any status change of the previous vehicle operator, however, a login request is transmitted by the new vehicle operator. If a predetermined maximum number of vehicle operators are already logged into a particular MCT when a new operator desires to log on, one of two possible methods to resolve the conflict is available. In the exemplary embodiment using the above-described menu driven system, the new vehicle operator chooses which previous vehicle operator is to be logged off from the validation system. The new operator scrolls to the chosen operator's name and requests a logoff, then transmits a login request using his or her username and password. In an alternative embodiment, processor 205 automatically logs one of the previous operators off of the system using a predetermined algorithm. For example, processor 205 could remove the operator with the oldest login time, or an operator who has not been the active operator for more than a predetermined amount of time.

Database 210 is accessible to fleet management center 110 as well as MCT 200. Fleet management center 110 communicates with database 210 in order to create, delete, or modify vehicle operator records. If a new vehicle operator record is to be created or modified, the operator's full name and vehicle operator identification code is provided by fleet management center 110 to database 210 via central station 102. Other information may be included as well. For example, a second username and/or password identifying the same vehicle operator may be provided to database 210 for use with an electronic application requiring its own username and/or password. If an operator record already exists on database 210 which matches the requested record, the old record is modified with the new information. If no record exists matching the requested vehicle operator, a new record is created, and fleet management is apprised of the failure to locate an existing operator. An acknowledgment message may be transmitted from central station 102 to fleet management center 110 confirming the creation/modification request and also to inform fleet management if the request was successful. In addition, in the exemplary embodiment, a vehicle operator will be automatically logged off of the validation system whenever his information is modified in database 210.

If it is desired to delete an existing vehicle operator record, an appropriate request is sent from fleet management center 110 to database 210. The request contains information identifying the vehicle operator record to be deleted. An acknowledgment message is transmitted from central station 102 to fleet management center 110 confirming the deletion request and also to inform fleet management if the request was successful or not. A failure may occur if the vehicle operator record to be deleted is not found on database 210.

Fleet management center 110 is also capable of ordering a logoff of any vehicle operator who is currently logged onto the system. A logoff command is sent by fleet management center 110 to central station 102 identifying the operator to be logged off. Processing device 208 receives the logoff command from interface device 214, then locates the operator's status in database 210. If the identified operator is logged onto the system, the operator's status is changed to "logged off" and a message is transmitted to MCT 200 informing it of the status change. At MCT 200, any electronic applications relying on a valid operator identification are notified of the status change as well. Again, an acknowledgment message may be sent by central station 102 to fleet management center 110 in response to the logoff request. A forced logoff may occur, for example, if it is known that an active vehicle operator is no longer operating the vehicle.

Fleet management center 110 may query database 210 to determine which operators are logged onto a specified MCT (an MCT query) or to determine the status and location of a vehicle operator (an operator query). An MCT query retrieves information from database 210 as to which vehicle operators are currently logged into the specified MCT, either as active or inactive operators. It should be understood that in the exemplary embodiment of the present invention, an active or inactive status can not be determined by accessing database 210. This is because the active/inactive status is not transmitted to central station 102. Only the "logged in" or "logged off" status is obtained and stored in database 210. An operator query retrieves information from database 210 as to which MCT the specified vehicle operator is logged onto, if any.

Each MCT in the communication system is assigned to only one of many fleet management centers in the system. Each fleet management center may only communicate with their corresponding MCTs. Therefore, an MCT query may only be made which corresponds to a particular fleet management's MCTs.

Fleet management center 110 may customize a number of system parameters associated with the validation/verification system to meet specific needs by communicating with central station 102. For example, fleet management center 110 may enable or disable the entire validation system at any time. The number of failed login attempts before a security alert is generated may be changed or disabled. The distance or time traveled without a valid active operator logged on may be varied or disabled. The time between beeps indicating a failure to log onto the validation system may be changed or disabled. The automatic log off feature after a predetermined amount of engine inactivity may be modified or disabled. The status of any of these predetermined settings may be requested by fleet management system 110 at any time.

Finally, fleet management center 110 may request operational data for each vehicle or each vehicle operator, as needed. The database will return all data which was recorded from the vehicle/vehicle operator since the last time information was retrieved. This information may be stored in either buffer 206, another memory onboard vehicle 108, database 210 or data storage unit 212.

In the exemplary embodiment, if a security alert is transmitted by MCT 200, the MCT identification number, date and time of violation, and the type of alert is transmitted to central station 102. Fleet management center 110 is notified of the alert as well as other electronic applications which can use the security information.

A variety of other information may be determined by either MCT 200 or by central station 102 whenever a login, logoff, or security alert is generated. For example, the name of the nearest large city or the name of the nearest city (any size) may be calculated and provided to fleet management center 110. Information associated with any identified cities may include the state in which the identified city is located, the zip code, and number of miles away and direction the particular MCT is from the identified city.

Figure 3:
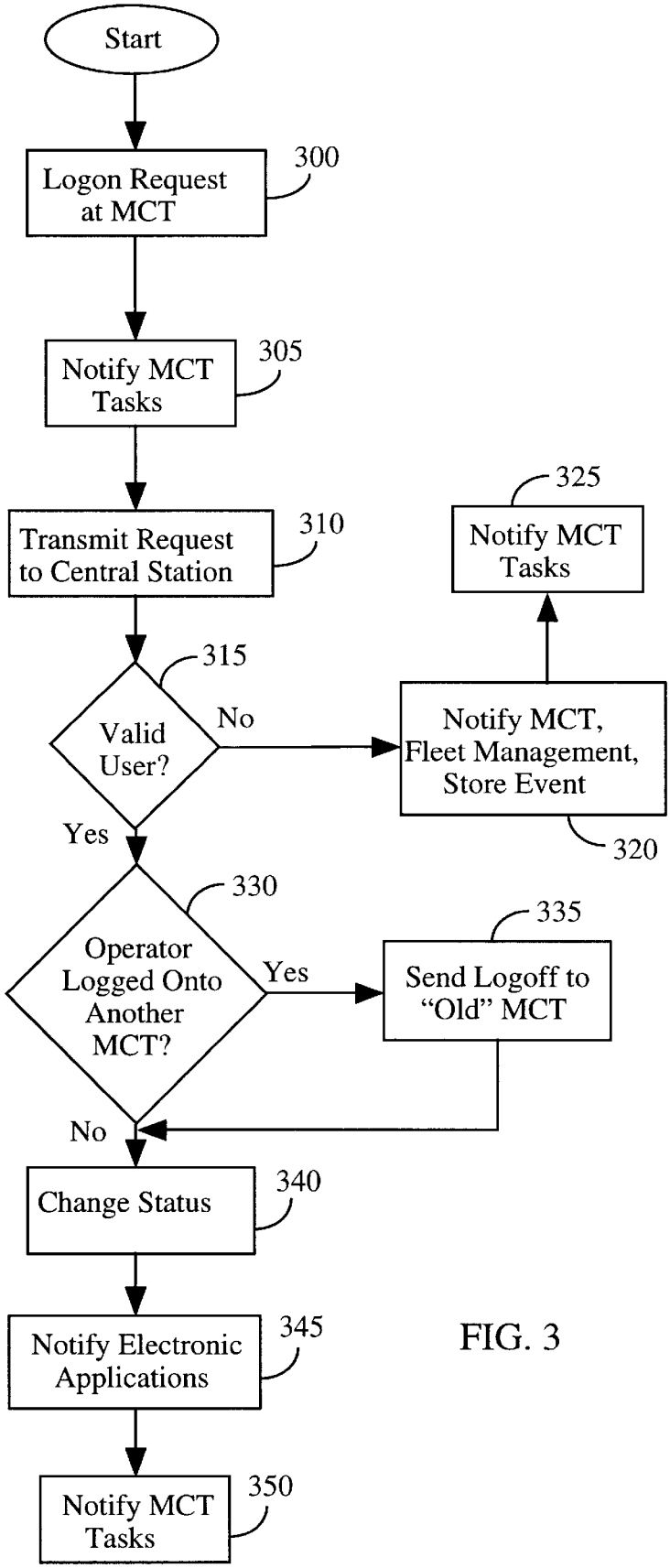
FIG. 3 is a flow chart detailing the method of validating vehicle operators in accordance with the present invention.

FIG. 3 is a flowchart detailing the steps which are performed during a login request. A vehicle operator desiring to log onto the validation system begins by requesting a login at MCT 200, shown as step 300. Typically, a unique username and password is entered by the requesting vehicle operator. The vehicle operator logs onto the system as either an active or an inactive operator.

In step 305, various onboard applications are notified of the login. For example, an electronic monitoring system which records the vehicle's operating characteristics will begin to record these characteristics under the active operator's name. A security feature onboard the vehicle can also be apprised of the operator's login.

In step 310, the login request is transmitted by transceiver 204 to central station 102. In the exemplary embodiment, the operator's username, password, MCT identification number, and time of login are transmitted.

In step 315, processing device 208 searches database 210 to determine if the received username is stored within the database, and if so, whether the received password matches the password corresponding to the username in database 210. If no such username is found, or if the username is found, but the transmitted password does not match the password stored in database 210, step 320 is performed which transmits a message to MCT 200 and to fleet management center 110 indicating that a failed login was detected. A record of the login attempt is also stored in either database 210 or data storage unit 212. MCT 200 in turn notifies the vehicle operator of the failed login request via user interface 202. MCT 200 also notifies the onboard applications that the login request failed.

If a valid username and password is detected in step 315, a check is performed in step 330 to determine if the requesting operator is currently logged onto another MCT. This situation would occur if the operator failed to logoff from a previous MCT or if a logoff was entered, but not communicated, to central station 102. If any event, if it is detected that the requesting operator is currently logged onto another MCT, a message is transmitted to the previous MCT ordering an logoff in step 335.

If the requesting operator is not logged onto another vehicle, the operator's status is changed in step 340 to "logged in" in database 210 along with the MCT identification number and the time of the login request. In step 345, a message is transmitted to MCT 200 indicating a successful login, including any other information useful to an onboard electronic monitoring application, such as a second unique identification number, formatted for the specific onboard application. A message is also transmitted to fleet management center 110 and to other electronic applications such as e-mail gateway 218, identifying the vehicle operator and associated MCT identification number.

Finally, in step 350, MCT 200 notifies any onboard applications of the successful login. For example, MCT 200 may notify an onboard vehicle performance recording system of the successful login by providing a unique operator identification number transmitted by central station 102.

Figure 4:
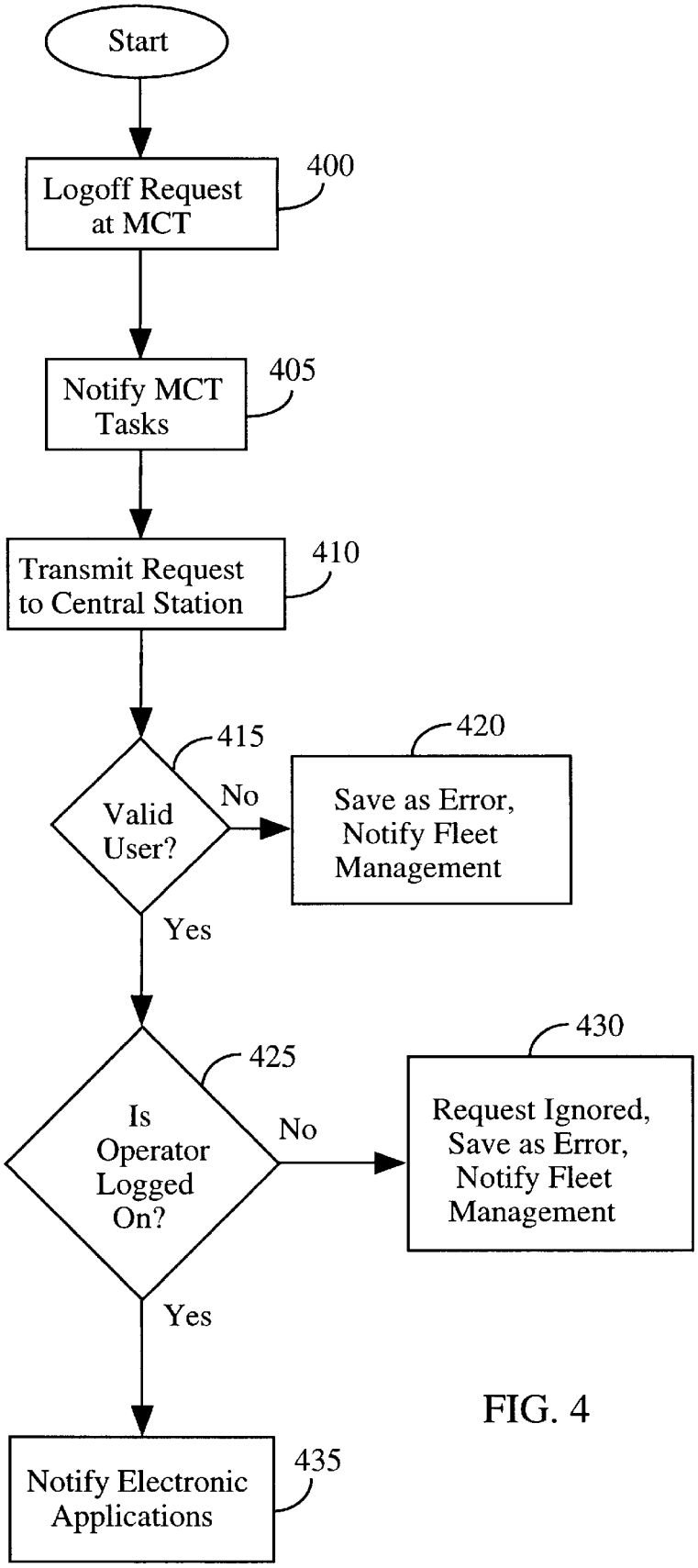
FIG. 4 is a flow chart detailing the method of logging off of the validation system of the present invention.

FIG. 4 is a flow chart detailing the steps performed during an operator logoff from the validation system. In step 400, a vehicle operator who has previously logged onto the validation system requests a logoff by entering a unique, preassigned username and password into user interface 202. In the exemplary embodiment, a menu driven display is used to minimize input errors by the vehicle operator. An operator wishing to logoff from the validation system scrolls through a list of operators, selects his or her name, then enters the logoff request. No password is needed to logoff from the validation system in the exemplary embodiment.

In step 405, a logoff message is sent to any onboard electronic systems which require an identified vehicle operator. For example, a onboard security system could be notified of the requested logoff, and begin monitoring the vehicle for unauthorized movement.

In step 410, the logoff request is transmitted from MCT 200 to central station 102. The logoff request contains, as a minimum, the username associated with the operator requesting logoff.

The request is received at central station 102 and routed to processing device 208, where database 210 is searched for the requested username. In step 415, if no record in database 210 matches the transmitted username requesting logoff, an error message is generated in step 420 and stored in data storage unit 212 or database 210 and/or transmitted to the appropriate fleet management center.

If the requesting username is detected as a valid record in database 210, step 425 is performed which determines if the requesting operator is currently logged onto the validation system. If the requesting operator is not found as having a "logged on" status, an error message is generated in step 430 and saved in either data storage unit 212 or database 210, and/or transmitted to the appropriate fleet management system.

If the requesting operator's login status is determined to be "logged on" in database 210, the login status is changed to "logged off" and a message is transmitted to fleet management center 110 as well as any electronic applications in need of such information. For example, e-mail gateway 218 will be notified of the operator's status change, and any e-mail messages directed at that operator will be stored until the operator logs into the validation system again.

Figure 5:
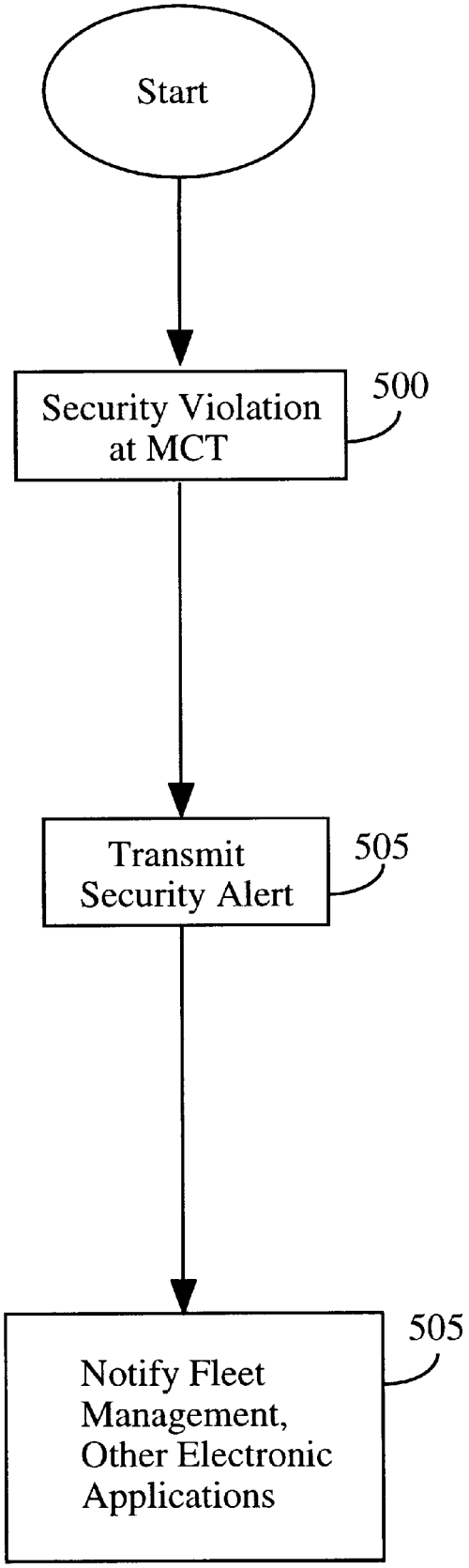
FIG. 5 is a flow chart detailing the method of generating a security alert in the validation system of the present invention.

FIG. 5 is a flow chart detailing the steps performed during a security violation onboard vehicle 108. In step 500, a security alert is generated at MCT 200 upon the occurrence of any one of a number of possible login-based security violations. For example, if vehicle 108 is operated without having an active operator logged into the validation system, a security alert will be generated after vehicle 108 has been operated for more than a predetermined distance or time. An audible and/or visual signal may be generated at MCT 200 prompting an operator to log into the system until such a login is attempted.

In step 505, MCT 200 transmits the security alert, identifying which MCT the alert is being generated from, the type of violation, and the time when the alert was generated.

In step 510, central station 102 relays the security alert and corresponding information to fleet management center 110 corresponding to the MCT which generated the security alert. Central station 102 also notifies any other applications in need of such information.

In another embodiment, processing device 208 records the number of consecutive, failed login attempts made from a single MCT. If the number of unsuccessful login attempts exceeds a predetermined number, all further login attempts will be denied. The fleet management center associated with the particular MCT will be notified and no further logins from the MCT will be permitted until the corresponding fleet management center sends a message allowing logins to continue.

The previous description of the preferred embodiments is provided to enable any person skilled in the art to make or use the present invention. The various modifications to these embodiments will be readily apparent to those skilled in the art, and the generic principles defined herein may be applied to other embodiments without the use of the inventive faculty. Thus, the present invention is not intended to be limited to the embodiments shown herein but is to be accorded the widest scope consistent with the principles and novel features disclosed herein.

We claim:

1. An apparatus for identifying and validating vehicle operators to multiple electronic systems in a communication system having a central station and a plurality of vehicles, wherein each vehicle is assigned a unique vehicle identification code and each vehicle operator is assigned a unique identification code, said apparatus comprising:

a database for storing a first operator identification code corresponding to a first vehicle operator in the communication system;

a communication terminal for transmitting an access request to a central station;

a first processing device connected to said database for determining if said access request should be granted or denied; and means for providing a second operator identification code corresponding to said first vehicle operator to an electronic system for allowing said first user access to said electronic system if access is granted, said electronic system for validating said first vehicle operator using said second operator identification code.

2. The apparatus of claim 1 wherein said first operator identification code is a preassigned alpha-numeric code which is unique to every vehicle operator in said communication system.

3. The apparatus of claim 2 wherein said preassigned alphanumeric code comprises a username and a password.

4. The apparatus of claim 1 wherein said communication terminal is located onboard said vehicle.

5. The apparatus of claim 1 wherein said electronic system is selected from the group consisting of a fleet management center, an e-mail system, an automatic log system, a vehicle security system, and an electronic vehicle monitoring system.

6. The apparatus of claim 1 further comprising a timer for generating an indication of when said access request occurred, wherein said communication terminal additionally transmits said indication along with said access request.

7. The apparatus of claim 6 wherein said indication is the number of seconds elapsed from a predetermined date.

8. The apparatus of claim 1, further comprising:

a second processing device onboard said vehicle for detecting when a vehicle ignition is turned off;

a timer for determining the a mount of elapsed time from when said vehicle ignition is turned off;

wherein said second processing device transmits a logoff message to said central station if said elapsed time exceeds a predetermined amount of time.

9. The apparatus of claim 1 wherein said access request is selected from the group consisting of a login and a logoff request.

10. The apparatus of claim 1 wherein said central station comprises transmission means for transmitting an acknowledgment message to said vehicle indicative of whether said access request was granted or not.

11. The apparatus of claim 10 further comprising:

a buffer onboard said vehicle for storing at least an operator identification code and a time indication of when said access request occurred.

12. The apparatus of claim 11 wherein said communication terminal comprises means for re-transmitting at least said operator identification code, said vehicle identification code, and said time indication to said central station if said acknowledgment message is not received by said communication terminal within a predetermined amount of time.

13. The apparatus of claim 1 wherein a name of said first vehicle operator is stored in said database corresponding to said first operator identification code.

14. The apparatus of claim 1 wherein said database is configurable by a fleet management center.

15. The apparatus of claim 1 wherein the means for providing said second operator identification code is further for providing a third operator identification code associated with said first vehicle operator to a second electronic system, said second electronic system for validating said first vehicle operator using said third operator identification code.

16. A method of identifying and validating vehicle operators to multiple electronic systems in a communication system having a central station and a plurality of vehicles, wherein each vehicle is assigned a unique vehicle identification code and each vehicle operator is assigned a unique vehicle operator identification code, said method comprising the steps of:

transmitting a first operator identification code corresponding to a first vehicle operator and a vehicle identification code to a central station;

receiving said first operator identification code and said vehicle identification code by said central station;

determining the presence or absence of said received first operator identification code within a database; and providing a second operator identification code corresponding to said first vehicle operator to an electronic system for allowing said first user access to said electronic system, said electronic system for validating said first vehicle operator using said second operator identification code.

17. The method of claim 16 wherein each of said first and second operator identification codes is a preassigned alphanumeric code which is unique to every vehicle operator in said communication system.

18. The method of claim 17 wherein said preassigned alpha-numeric code comprises a username and a password.

19. The method of claim 16 wherein said electronic system is selected from the group consisting of a fleet management center, an e-mail system, an automatic log system, a vehicle security system, and an electronic vehicle monitoring system.

20. The method of claim 16 wherein an indication of when said access request occurred is also transmitted along with said first operator identification code and said vehicle identification code.

21. The method of claim 20 wherein said indication is the number of seconds elapsed since a predetermined fixed date.

22. The method of claim 16 further comprising the step of automatically transmitting a logoff message to said central station if a predetermined amount of time has elapsed from when a vehicle ignition is turned off.

23. The method of claim 16 further comprising the step of transmitting an acknowledgment message from said central station to said vehicle indicative of receipt of said first operator identification code and said vehicle identification code.

24. The method of claim 23 wherein the step of transmitting comprises:

storing said first operator identification code, and a time indication of when said access request occurred in a buffer onboard said vehicle; and transmitting said first operator identification code, said time indication, and said vehicle identification code to said central station.

25. The method of claim 24 further comprising the step of re-transmitting said first operator identification code, said time indication, and said vehicle identification code to said central station if said acknowledgment message is not received by said vehicle within a predetermined amount of time.

26. The method of claim 16 wherein a name of said first vehicle operator is stored in said database corresponding to said first operator identification code in said database.

27. The method of claim 16 wherein said database is configurable by a fleet management center.

28. The method of claim 16 further comprising the step of providing a third operator identification code associated with said first vehicle operator to a second electronic system, said second electronic system for validating said first vehicle operator using said third operator identification code.

* * * * *